United States Patent [19]

Kummerow et al.

[11] 4,254,314

[45] Mar. 3, 1981

[54] ARCING CHAMBER WITH PERFORATED PLATES OF SIEVE-LIKE CERAMICS

[75] Inventors: Gerd Kummerow; Günter Prietzel, both of Berlin, Fed. Rep. of Germany

[73] Assignee: Siemens Aktiengesellschaft, Munich, Fed. Rep. of Germany

[21] Appl. No.: 941,941

[22] Filed: Sep. 13, 1978

[30] Foreign Application Priority Data

Sep. 15, 1977 [DE] Fed. Rep. of Germany ..... 2741868

[51] Int. Cl.[3] ..... H01H 33/08

[52] U.S. Cl. ..... 200/144 R; 200/147 R

[58] Field of Search ..... 200/144 R, 144 C, 147 B, 200/148 C, 306, 147 R, 147 A; 335/201; 337/282

[56] References Cited

U.S. PATENT DOCUMENTS

| | | | |
|---|---|---|---|
| 2,306,204 | 12/1942 | Boehne | 200/144 R |
| 2,393,164 | 1/1946 | Hobson | 200/147 B X |
| 2,623,139 | 12/1952 | Weston | 200/147 R |
| 2,836,683 | 5/1958 | Souchet | 200/144 R |
| 2,861,152 | 11/1958 | Scully | 200/147 B X |
| 2,942,084 | 6/1960 | Boehne | 200/144 R |
| 3,649,791 | 3/1972 | Kruckewitt | 200/148 C X |
| 4,019,006 | 4/1977 | Strössner | 200/144 R |

FOREIGN PATENT DOCUMENTS

| | | | |
|---|---|---|---|
| 1177722 | 9/1964 | Fed. Rep. of Germany | 200/144 R |

*Primary Examiner*—James R. Scott

*Attorney, Agent, or Firm*—Kenyon & Kenyon

[57] ABSTRACT

An arcing chamber for electric power circuit breakers is disclosed in which perforated, sieve-like ceramic plates define a wedge-shaped arcing space.

An essential part of the disclosure is the use of conical holes in the plates which decrease in diameter from the arcing space sides of the plates toward the outside. The hole size used in areas where the arc travels and is quenched differs from that used in the remaining part of the arcing space. The space where the arc originates is made without holes.

The invention is suitable particularly for fast-acting D.C. breakers.

5 Claims, 4 Drawing Figures

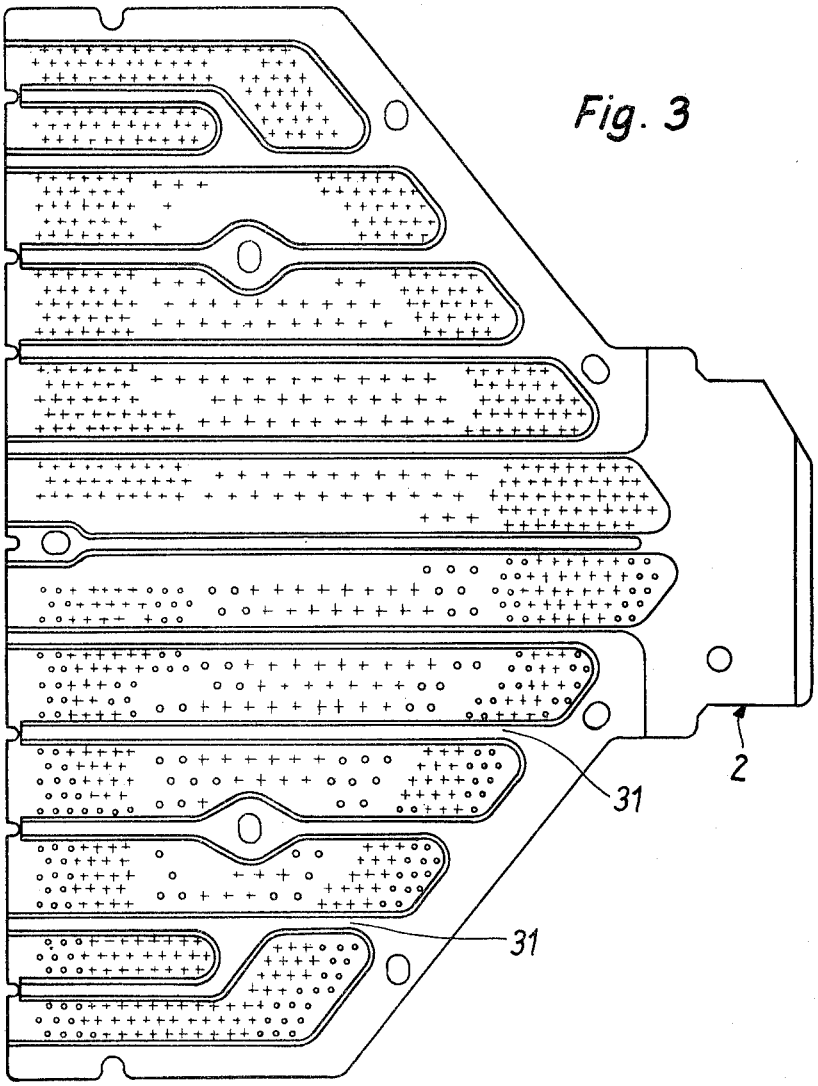
Fig. 3
Fig. 4
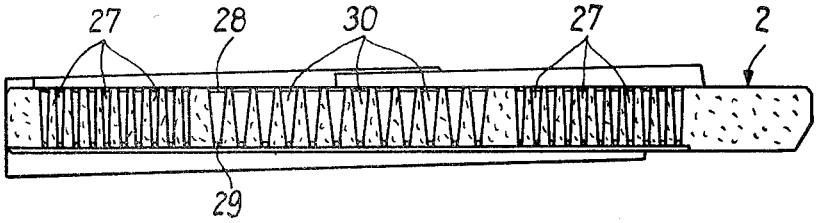

ARCING CHAMBER WITH PERFORATED PLATES OF SIEVE-LIKE CERAMICS

BACKGROUND OF THE INVENTION

This invention relates to an arcing chamber for electric power circuit breakers, especially fast acting D.C. breakers, in which a wedge-shaped arcing space is defined by perforated, sieve-like, ceramic plates.

Such an arcing chamber has been described in the German Offenlengungsschrift No. 19 33 529 in which the perforated plates enable pressure equalization to occur, so that the travel of the arc is not impeded. In the process, arc gases pass through the holes in the perforated plates and are cooled and deionized. In spite of these good properties of the ceramic sieve, it has been found that only a limited number of circuit interruptions can be performed, since, under the influence of the heat of the arc, the surfaces of the ceramic sieve plates become vitrified and the holes are partially or totally closed off. Attempts to avoid this vitrification by enlarging the holes have been unsuccessful, since the flow of gas through the holes became so heavy that, due to continued ionization, breakdowns occurred outside the arcing space with consequent failure of the breaker.

It is an object of the invention to maintain a large quenching capacity in the arc chamber while preventing clogging of the holes in the ceramic sieve; at the same time, ejection of gas to the outside of the arcing chamber is reduced to such an extent that little spacing between it and nearby grounded parts is needed.

BRIEF SUMMARY OF THE INVENTION

According to the invention, this problem is solved by tapering the holes in the perforated plates; thus, they are conical and have diameters decreasing from the inside surface toward the outside. The conical hole shape results in an increase in the surface area effective for cooling and so reduces the tendency of the ceramics to be vitrified. Also, a smaller amount of gas escapes to the outside from the conical holes and the danger of external breakdowns is reduced.

Further, in accordance with the teachings of the invention, the perforations are made of different sizes, the different sized holes being distributed over the plates in such a way that there are no holes in the space where the arc originates, small holes are used in the area adjoining the point of arc origination and in the narrowest portion of the wedge-shaped arcing space, and larger holes are provided in the central area of the arcing chamber. This disposition of the holes is used to control the quenching process. In particular, the base point of the arc on the running tracks customarily provided in arcing chambers can form rapidly, and an accelerated lengthening of the arc and intensive cooling in the end position are brought about without a tendency for the arc to "step out" of the quenching chamber.

A further favorable effect on the quenching action is obtained by providing a gap between the perforated plates adjacent to the narrowest area of the wedge-shaped arcing chamber and by connecting to it a cooling space, subdivided by partitions, which is laterally bounded by impermeable walls and closed in the direction of arc travel by a perforated plate. Tests have shown that the temperature of escaping gases outside the perforated plate is so low that there is no danger of external breakdowns; grounded parts can, therefore, be arranged at a small distance from the cooling space. The space requirements for power circuit breakers in switching plants are thus reduced.

The sides of the perforated plates outside of the arcing chamber are equipped with ribs extending in the direction travel of the arc. Gases passing through the holes of the ceramic sieves are thus directed towards the cooling space and the danger of a breakdown on the outside of the ceramic sieve plates is eliminated.

The side walls of the cooling space can be designed uniformly with bulkheads arranged at a distance from the perforated plates. These partitions thus form the outer boundary of the arcing chamber.

BRIEF DESCRIPTION OF THE DRAWINGS

FIG. 3 is a plan view of one of the perforated plates as seen from the outside.

FIG. 4 is a partial cross-section through one of the perforated plates showing the conical perforations.

DETAILED DESCRIPTION OF THE INVENTION

Figure 1:
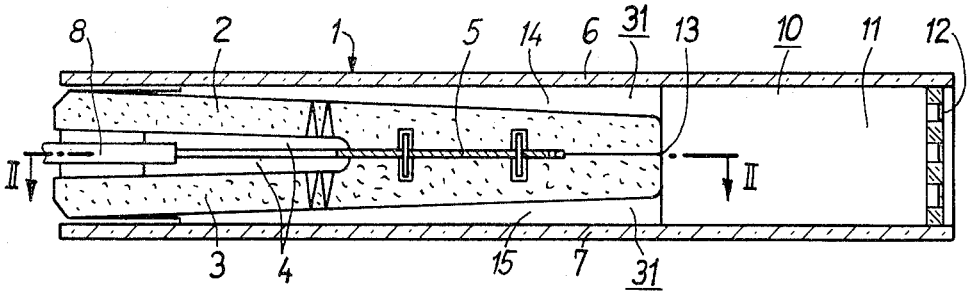
FIG. 1 is a view in vertical cross-section taken at lines II–II of FIG. 2 showing an arcing chamber embodying the principles of the invention.

It will be seen from FIG. 1 that the arcing chamber 1 contains two plates 2 and 3 of porous or sieve-like ceramic which are arranged with surfaces sloping toward each other to define an arcing space 4 into which the contacts 8 and 9 (schematically indicated) of the associated power circuit breaker extend from below (e.g., the left, in FIGS. 1 and 2). An intercept electrode 5 is located in the center of the arcing space 4 and serves to divide the moving arc into two partial arcs as will be explained below. The arcing chamber 1 is terminated laterally (e.g., vertically in FIG. 1) by impervious plates 6 and 7, which are extended to form the side walls of a cooling space 10 located above (in FIG. 1, to the right of) the perforated plates 2 and 3. The cooling space 10 is subdivided by partitions 11 positioned transversely to the arc; it is closed at the top by a perforated plate 12. The arc gases escaping from the arcing space 4 therefore flow into the cooling space 10 through a gap 13 provided at the point of least separation between the perforated plates 2 and 3, as well as from the spaces 14 and 15 formed by the outer sides of the plates 2 and 3 and enclosure plate walls 6 and 7.

The arcing space 4 between the plates 2 and 3 is divided into several zones. A space 20, in which the arc originates and whose associated plate areas are free of holes immediately surrounds the contacts. Following the direction of arc travel (to the right), an arc next enters travel space 21, which is laterally enlarged, like a funnel, in the plane of the arc and which is bounded in its upper part by parallel walls. Finally, the arc reaches a quenching space 22 which is in communication with the cooling space 10 via the gap 13.

Figure 2:
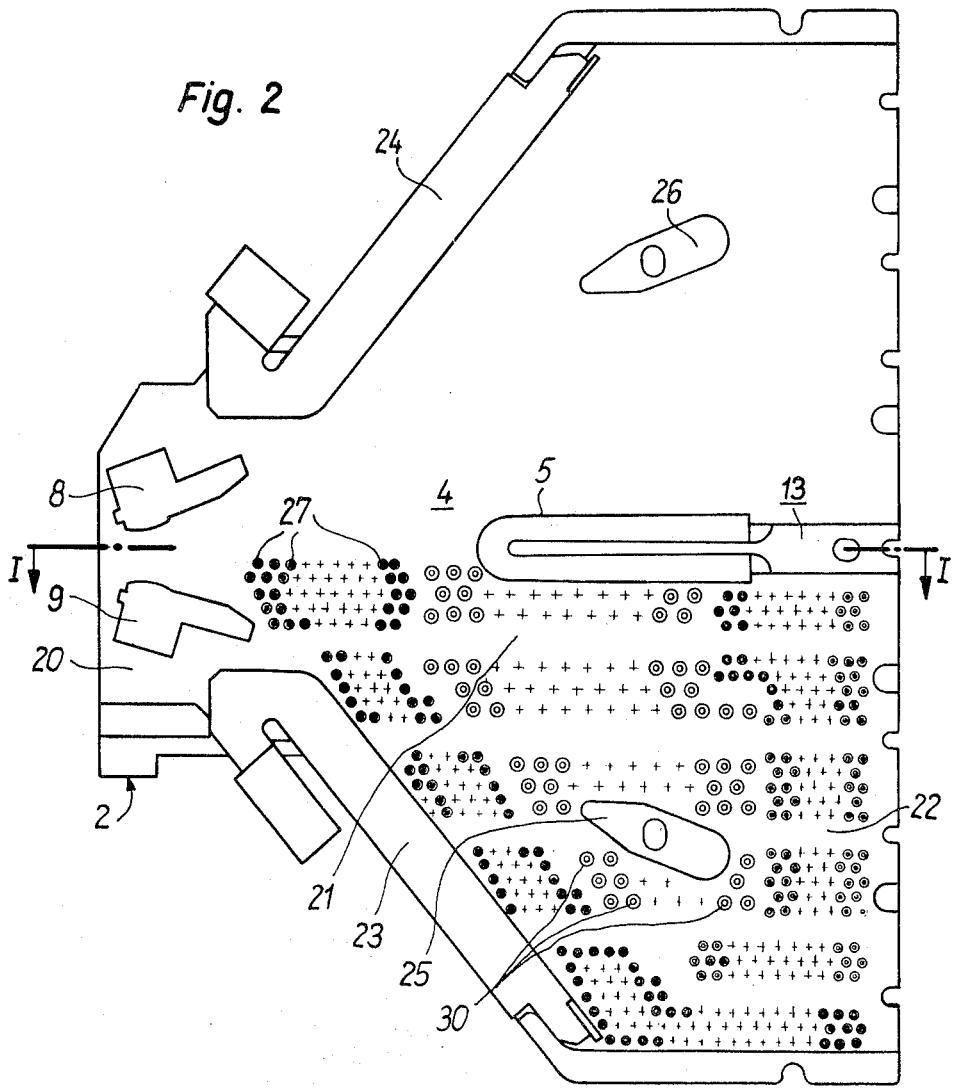
FIG. 2 is a plan view of the inside surface of a perforated ceramic plate forming a wall of the arcing chamber of FIG. 1, taken along the lines 1–1 and showing the location of cooperating electrodes.

Arc tracks 23 and 24, best seen in FIG. 2, are inserted between the outer bounds of the plates 2 and 3; they are maintained at the same potential as the contacts of the power circuit breaker and can therefore take over the arc as it rises from the contacts. The running tracks 23 and 24 work in conjunction with the two wedge electrodes 25 and 26 and the intercept electrode 5 in the axis of the arcing space 4 to divide and greatly lengthen the arc.

It is a feature of the invention that the plates 2 and 3 are perforated by a multiplicity of conical holes of differing size. The space 20 in which the arc originates is kept free from perforation however. Adjoining the space 20, the first holes 27 encountered by an arc travelling 21 are made small, as are those arranged at the edge of the arcing space 4 next to the running tracks 23 and 24 and those in the quenching space 22. The remaining area of the arc travel space, i.e., about the central zone of the arcing space 4, is provided with larger holes 30.

The conical shape of the holes can best be seen in FIG. 4 where the larger holes 30 open onto the arcing space 4 with a large diameter 28, with a smaller diameter 29 being provided on the outside. In a preferred embodiment of the invention, the diameter 28 is twice as large as the diameter 29. The smaller holes 27 exhibit a similar shape. The larger diameter of the holes can be in the order of a few millimeters; the total number of holes in each plate 2 and 3 may be several hundred or thousands, depending on the size of the plate.

FIG. 2 further shows arrangement of the holes 27 and 30 into a number of hole groups placed between ribs 31 (visible in FIG. 3) which are not perforated. The ribs 31 project outwardly from the outer surfaces of plates 2 and 3 and extend in the direction of travel of the arc. The ribs 31, together with plates 6 and 7, form channels in the lateral spaces 14 and 15 (FIG. 1) which conduct the arc gases passing out of the holes 27 and 30 into the cooling space 10.

At the beginning of an interruption process, the arc is drawn between the schematically indicated contacts 8 and 9 in the arc originating space 20. The horns of the contacts lead the arc onto the running tracks 23 and 24 on which base points are formed rapidly because this area of the arcing space 4 is kept free of holes. Through magnetic blasting and thermal buoyancy, the arc gets into the flared, funnel-shaped, arc travel space 21, where the arc first sweeps over an area of smaller holes 27 and then reaches the area of the larger holes. With high travel velocity, the arc is now greatly lengthened and gets to the quenching zone 22 which is again provided with smaller holes 27. Because of the reduced spacing of the perforated plates 2 and 3 and the considerable lengthening of the arc, the quenching effect is intense. The arc gases enter the cooling space 10 through the gap 13 and are there cooled so far that no temperature sufficient for a breakdown exists on the outside of the perforated plate 12. Therefore, grounded parts can be arranged above the plate at a relatively close distance. This is advantageous for the installation of power circuit breakers in switching plants or vehicles.

What is claimed is:

1. An electric arc extinguishing apparatus having an arcing chamber for use in electric power circuit breakers, such as fast-acting DC breakers, comprising:

a pair of quenching plates defining a wedge-shaped arcing space, each quenching plate being of sieve-like ceramic having perforations extending from the arcing space to the outside;

one end of the arcing space comprising a region for receiving arcing electrodes where an arc originates for travel through an arc travel region to a quenching zone, the arc travel region having a first zone next to the region of arc origination and a central zone;

each quenching plate having conical perforations the diameters of which decrease in size from the side of the plate next to the arcing space to the outside; and each quenching plate being free of such perforations in the region of arc origination, having perforations of a smaller diameter next to the first zone, and having larger perforations next to the central zone.

2. The electric arc extinguishing apparatus of claim 1 further comprising the quenching plates having locations for running tracks on either side of the arcing space and containing perforations of smaller diameter in areas adjacent to the locations of running tracks.

3. An arcing chamber in accordance with any one of claim 1 or claim 2 further comprising:

a gap between the quenching plates at the end position of the arc for coupling the arc travel space to a cooling space; and a cooling space having impervious side walls and having a perforated end plate opposite the gap.

4. An arcing chamber in accordance with claim 3 comprising side walls on the outside of and spaced apart from the perforated plates, the side walls being extensions of side walls bounding the cooling space.

5. An arcing chamber in accordance with claim 1 further comprising ribs on the sides of the perforated plates facing away from the arcing space, the ribs extending in the direction of travel of the arc.

* * * * *